US005473340A

United States Patent [19]

Soltan et al.

[11] Patent Number: 5,473,340

[45] Date of Patent: Dec. 5, 1995

[54] APPARATUS FOR DISPLAYING A MULTI-COLOR PATTERN

[75] Inventors: Parviz Soltan; Thomas Phillips; Waldo R. Robinson; John Marez, all of San Diego; Randy Wyatt, Lake Forest; Margie M. Nicholson, San Marino, all of Calif.

[73] Assignee: The United States of America as represented by the Secretary of the Navy, Washington, D.C.

[21] Appl. No.: 588,890

[22] Filed: Sep. 27, 1990

[51] Int. Cl.[6] ..... G09G 3/38

[52] U.S. Cl. ..... 340/105

[58] Field of Search ..... 340/785, 783, 340/763; 350/357, 363, 361; 359/315, 298, 241, 242; 345/105, 106, 84

[56] References Cited

U.S. PATENT DOCUMENTS

| | | | |
|---|---|---|---|
| 3,026,417 | 3/1959 | Tomlinson | 250/211 |
| 3,443,859 | 3/1964 | Rogers | 350/357 |
| 3,502,885 | 3/1970 | Stewart | 250/211 |
| 3,589,896 | 6/1971 | Wilcox | 350/357 |
| 3,844,636 | 10/1974 | Maricle et al. | 350/357 |
| 4,010,376 | 3/1977 | Duck | 250/278 |
| 4,033,673 | 7/1977 | Seki | 340/785 |
| 4,272,164 | 6/1981 | Trussell, Jr. | 350/357 |
| 4,422,732 | 12/1983 | Ditzik | 359/315 |
| 4,431,989 | 2/1984 | Grange et al. | 340/785 |
| 4,599,614 | 7/1986 | De Berry et al. | 340/785 |
| 4,707,744 | 11/1987 | Kimata et al. | 358/213.26 |
| 4,743,972 | 5/1988 | Makihara | 358/213.11 |
| 5,105,303 | 4/1992 | Ilhage | 359/273 |
| 5,124,833 | 6/1992 | Barton et al. | 359/269 |

OTHER PUBLICATIONS

I. F. Chang and W. E. Howard, "Performance Characteristics of Electrochromic Displays", IEEE Trans, Electron, Rev. ED–22 pp. 749–758, Sep. 75.

Chang, "Controllable Pesistence In Electrochromic Effect and its Use in Beam Addressable Display", IBM (TDB) vol. 17, No. 10 Mar. 1975 pp. 3151–3153.

*Primary Examiner*—Richard Hjerpe
*Assistant Examiner*—Xiao M. Wu
*Attorney, Agent, or Firm*—Thomas E. McDonnell; Charles J. Stockstill

[57] ABSTRACT

An apparatus for displaying a multi-color pattern within a single device is shown and described. The apparatus utilizes an electrochromic light valve which comprises electrodes that cover a photoconductive layer and a two-dimensional plurality of electrochromic pixels. An insulating grid defines the electrochromic pixels in the multi-color display. Each electrochromic pixel has a conductive mirror onto which the electrochromic material is deposited. The electrochromic material and grid structure are covered by an electrolyte solution. Color selection for a given pixel is effected by applying a voltage pulse of controlled amplitude synchronized with a laser beam which illuminates the photoconductor associated with the addressed electrochromic pixel. The voltage applied when the laser beam addresses an electrochromic pixel determines the color of the pixel.

5 Claims, 2 Drawing Sheets

APPARATUS FOR DISPLAYING A MULTI-COLOR PATTERN

BACKGROUND OF THE INVENTION

This invention relates to color displays providing a plurality of colors for each pixel within the display. These displays may be used for pictures, information displays and panel data displays.

Prior art cathode ray tube color displays use additive color control. Three display spots, one for each primary color (red, green and blue), are required for each full color pixel on the display. This requires three beams of electrons, one for each of the three primary colors in a pixel. The display must have monochrome modulating devices for each of the three electron beams required to generate the colors.

Liquid crystal display devices used in multi-color displays have insufficient contrast, limited viewing angles and poor color capability. The poor color capability is true on segmented and dot matrix displays as well as on liquid crystal projected light valves for large screen displays. A major disadvantage of liquid crystal displays is the requirement for three separate channels, one for each primary color, to produce a full color display.

Certain organic and inorganic materials in electrochromic devices are capable of selective light absorption. White light passed through these materials forms a color image when unneeded frequencies are absorbed by the materials.

It is known that an electric field may be applied to a film of electrochromic material which is deposited between a transparent conductor and an aqueous electrolyte solution. This technique produces a blue or white display. It is also known that other color effects can be obtained with lutetiumdiphthalocyanine constructed in both opaque and translucent cell configurations. Colors ranging from rose through a somewhat neutral shade of gray, to green, blue-green, deep blue, and violet have been obtained by controlling the voltage applied to such materials.

Electrochromic light valves (ECLV) are known in the art. ECLVs have the capability of generating different colors within a single element when the voltage applied to the element is changed a few volts.

Light valves have become an important display technique for command and control display devices requiring large display areas and high brightness. However, light valves currently in use are not capable of producing multiple colors from a single pixel device. For full color display systems, three separate electrical and optical channels must be fabricated and combined to generate a composite picture. This approach requires additional space, weight, complexity, and cost. Also, these systems often require added maintenance to keep the three channels properly converged.

Display addressing is an important and vital part of any display device. For the projection displays, addressing by multiplexed circuitry and direct interfacing with display dot matrix material is not adequate. Active addressing is required for large displays. Unfortunately, if the active elements are placed on the display surface they take up part of the available display area. Loss of display area leads to limitations in resolution and brightness.

BRIEF SUMMARY OF THE INVENTION

Accordingly, it is an object of this invention to provide a pixel whose color can be controlled without controlling three primary color sub elements.

It is another object of the invention to provide a display addressing technique capable of controlling large display areas without embedding active elements within the display area.

It is another object of the invention to provide a display with high brightness, resolution, and contrast.

These and other objects are achieved with a laser beam for addressing a photoconductor in an electrochromic light valve (ECLV). This invention associates each pixel with a photoconductor; light from a laser beam controls the resistance of the photoconductor. The color of light absorbed by a electrochromic material is controlled by the magnitude of the voltage applied across it. When the laser causes the photoconductor to change its resistance to a low value, a voltage is applied across an electrochromic material thereby changing what wavelengths of light are absorbed. Synchronized with the laser beam is a voltage source controlling the magnitude of the voltage which will be applied across the electrochromic material when the photoconductor switch is turned on. Control of the applied voltage, combined with selection by the laser beam interacting with the photoconductor switch, controls the wavelengths absorbed and thus the color of the pixel. As white light passes through the electrochromic material, a portion of the spectrum is absorbed, and a controllably colored light emerges. The light which has passed through the electrochromic light valve pixel is projected on a screen.

DETAILED DESCRIPTION OF THE PREFERRED EMBODIMENT

The structure of the electrochromic light valve pixel comprises a photoconductor switch selectively applying a voltage across an electrochromic material and electrolyte when controlled light strikes the photoconductor.

Figure 4:
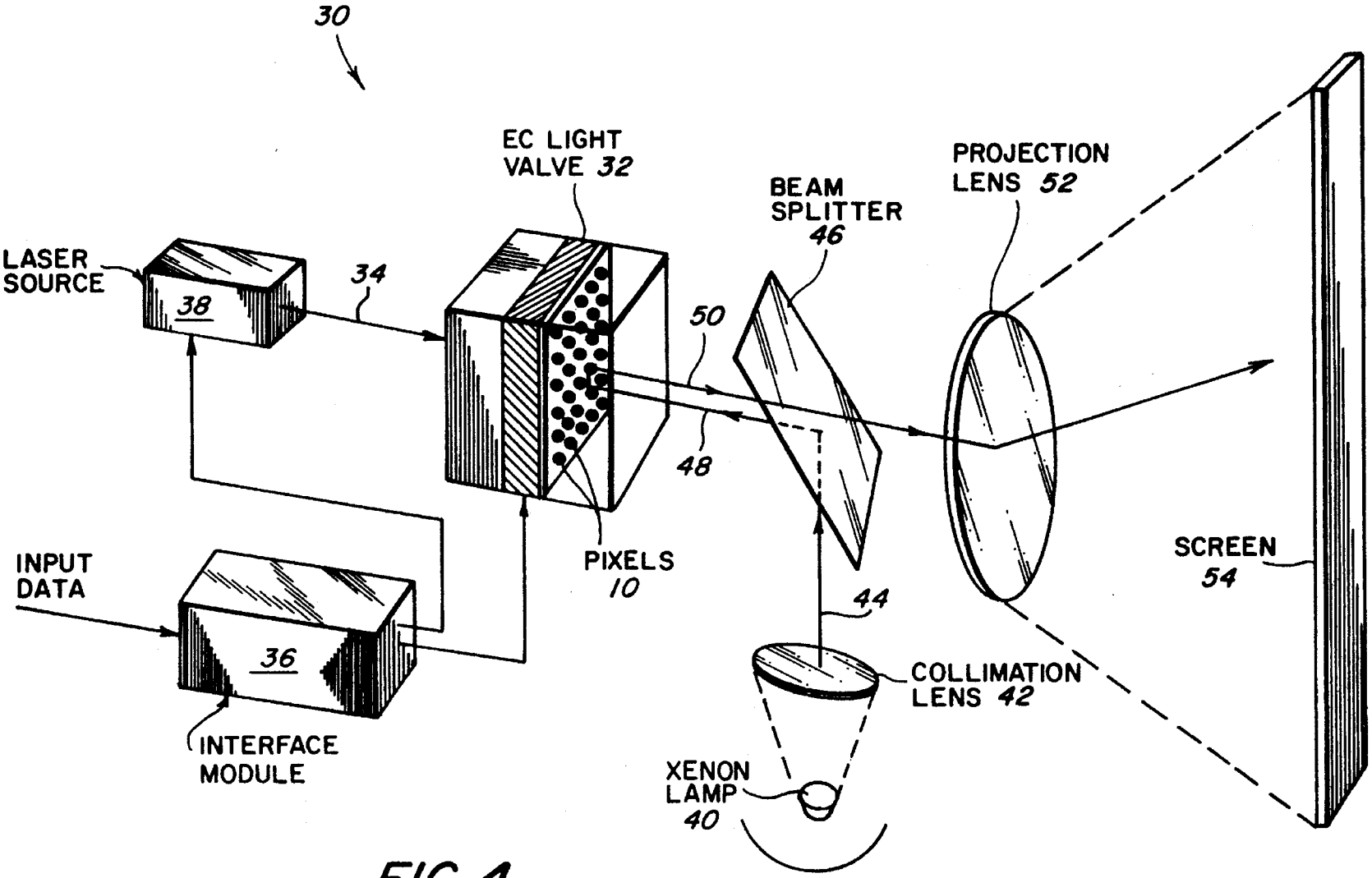
In FIG. 4 there is shown the overall arrangement of the electrochromic light valve and projection system of this invention.

The laser beam addressed electrochromic light valve projection system of this invention is shown generally in FIG. 4. The laser beam is scanned and optically modulated to produce an optical image on the input side of the light valve. This spatial image pattern is electronically transferred in parallel by the light valve pixel into a similar pattern in the electrochromic material. Light from a high intensity xenon arc lamp (white light) is modulated by the electrochromic layer and projected onto a display screen.

Figure 1:
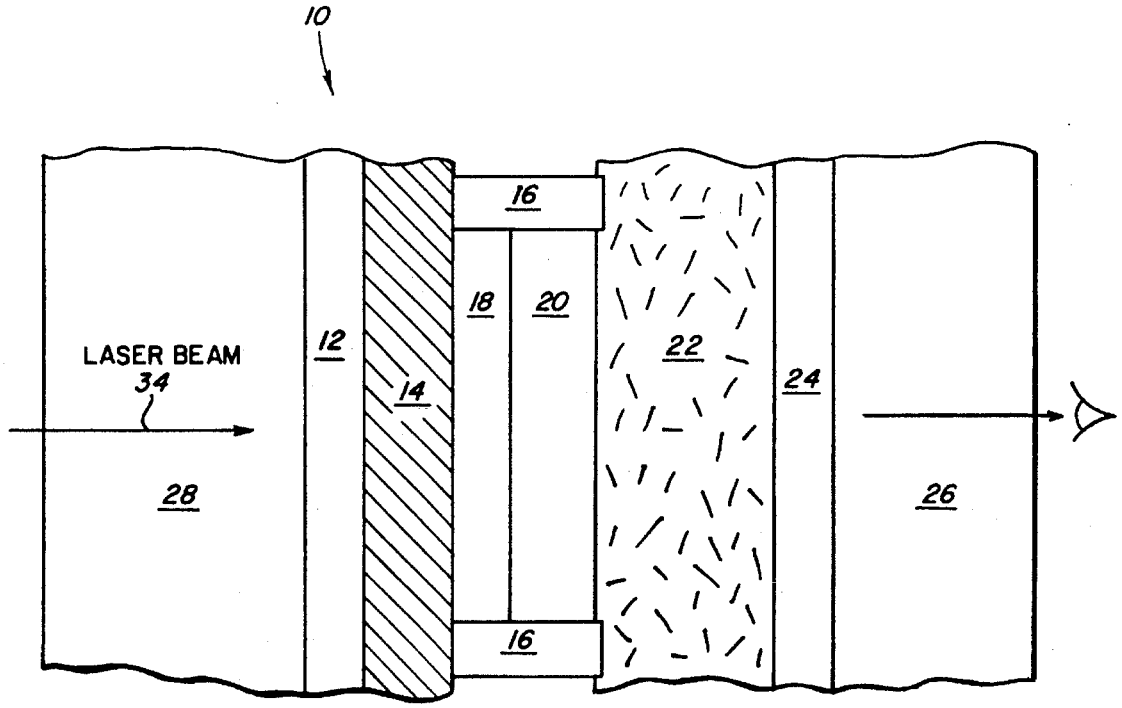
In FIG. 1 there is shown a cross-section of a single pixel portion of the electrochromic light valve.

FIG. 1 shows the construction of electrochromic light valve pixel or pixel 10 of the invention. Electrochromic dye or electrochromic dye material 20 absorbs different wave lengths of light as different voltages are developed across it. The voltage applied to the electrochromic dye is used to control the color of light absorbed and thus the color of the light passed by pixel 10. Light is projected through glass plate 26, transparent electrode or electrode 24 and electrochromic dye 20. The light reflects off of conductive mirror 18 and passes back through electrochromic dye 20, electrode 24 and exits from glass plate 26.

The electrochromic light valve of this invention comprises active layers or electrodes 12, 24 sandwiched between two protective layers of glass or glass layers 26, 28. Electrodes 12 and 24 are each a continuous transparent electrode that covers the two-dimensional array of pixels. Photoconductive layer or photoconductor 14 also covers the array. Insulating grid or insulator 16 defines the number of pixels in the array. Mirror 18 is deposited in each pixel; alternatively, mirror 18 may also cover the array while grid 16 isolates only the electrochromic dye 20. Electrochromic dye 20 is deposited on mirror 18 within each pixel defined by insulator 16. Electrolyte solution or electrolyte 22 covers insulator 16.

Galvanic action (spontaneous charge spreading) between neighboring pixels with different charge voltages would cause color spreading between adjacent pixels. To prevent this charge spreading, the electrochromic dye 20 of each pixel must be insulated. Photoconductor 14 provides a high impedance path between the electrochromic material of adjacent pixels. Similarly, a high impedance path is presented by electrolyte 22. Therefore, insulator 16 is provided to complete the isolation of electrochromic dye 20.

Figure 2:
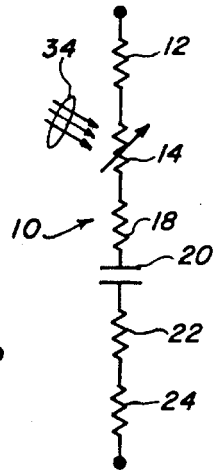
In FIG. 2 there is shown the series circuit which is formed across each pixel of the electrochromic light valve.

Because of the high impedance between the parallel pixel circuits, the pixels respond independently. FIG. 2 shows an electrical schematic of electrochromic pixel 10 in accordance with the invention. This schematic is a series connected circuit of the pixel elements from electrode 12 to electrode 24. Electrochromic dye 20 is represented as a capacitor because it holds the charge after the photoconductor 14 has been turned off when the laser illumination is removed. All other elements are represented as resistances.

Figure 3:
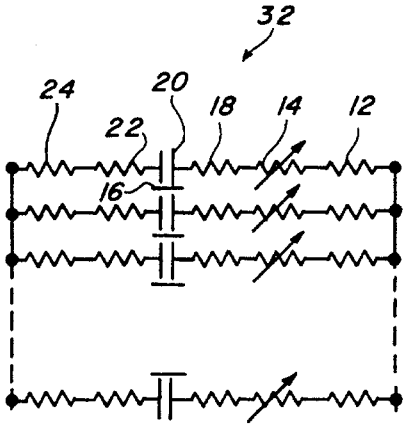
In FIG. 3 there is shown a schematic of the entire electrochromic light valve which comprises many pixels in parallel between the transparent electrodes.

In FIG. 3 there is shown an electrical schematic of the entire electrochromic light valve 32 wherein each pixel is shown as a series resistance and capacitance circuit in parallel with other similar circuits. These parallel circuits are located between transparent electrodes 12 and 24 as shown in FIG. 3. FIG. 3 also shows an insulator 16 between each parallel circuit. Insulator 16 provides for the isolation between parallel circuits which is necessary to prevent charge spreading.

The electrochromic light valve functions in the following manner. The normal state of photoconductor or photoconductive switch, 14 is a high impedance (around one million ohms/cm$^2$) which, in this device, is the off state. When photoconductor 14 is in the off state, voltage applied to the transparent electrodes 12 and 24 is virtually all dropped across the photoconductive switch: the voltage does not alter the charge on the capacitance of electrochromic dye 20. However, when laser beam 34 illuminates photoconductor 14, the impedance of photoconductor 14 drops to a low value (around 1 ohm/cm$^2$), in effect turning on the switch. The low impedance allows current to flow and charge the capacitance of electrochromic dye 20 to a new voltage. When the voltage across electrochromic dye 20 changes, the dye absorbs a different wavelength and, consequently, the pixel transmits a different color. As laser source 38 removes the laser illumination from photoconductor 14, the switch opens and the charge remains on electrochromic dye 20. Because the discharge time for the resistance-capacitance network is long with respect to the period between laser illuminations, the change is effectively fixed until the next time the photoconductive switch is illuminated. Depending on the dwell time during which each pixel is illuminated, the capacitance of electrochromic dye 20, and the total impedance of the charging path, it may take several passes to completely charge a pixel and thus change its color. The DC voltage applied to transparent electrodes 12 and 24 thus controls the colors to be absorbed and reflected. The typical range for the control voltage for a lutetium diphthalocyanine electrochromic film is ±1.2 volts. Because of the voltage loss in the resistance elements of pixel 10, the applied voltage is in the range of ±1.5 volts.

FIG. 4 shows a display system 30 incorporating an array of electrochromic pixels 10 making up electrochromic light valve 32 of this invention.

Display system 30 must correlate the magnitude of the voltage across electrodes 12, 24 to the pixel selectively illuminated by laser beam 34. This correlation is provided by interface module 36 which applies the voltage to electrodes 12, 24. Interface module 36 also provides deflection control to laser source 38 to control the scan of laser beam 34 and thus selectively enables a pixel 10 across which the voltage applied to electrodes 12, 24 will be developed. The charge developed across electrochromic dye 20 determines the color of light absorbed by the material. Light passing through the electrochromic material is filtered by the voltage controlled absorption in the electrochromic crystal.

The voltage applied to electrochromic dye 20 may be controlled by two different means. First, the voltage applied to electrodes 12, 24 may be controlled by the interface module while the intensity of scanned laser beam 34 is kept constant. A constant laser intensity limits photoconductor 14 to two impedance states. Alternatively, the intensity of laser beam 34 can be intensity modulated to make the impedance of photoconductor 14 continuously variable while the voltage applied to electrodes 12, 24 is kept constant. Control of the impedance of photoconductor 14 controls the voltage developed across the rest of the resistive capacitance circuit, and hence the voltage across electrochromic dye 20.

Since each pixel 10 of electrochromic light valve 32 will reflect a color of some hue, applied light beam 48 will not have to be modulated in intensity. However, if the scan rate of laser beam 34 is high enough that the transition time between pixels becomes significant with respect to the dwell time on each pixel, contrast and fringing problems may arise. To prevent fringing effects and maintain the best contrast, light beam 48 may have to be turned off while laser beam 34 moves from one pixel to the next. The long storage time of the electrochromic materials allows a slow scan technique with laser beam 34 incrementally moved across valve 32. Incremental movement makes the transition time a small portion of the dwell time. With long dwell times and short transition times, modulation of the writing beam may not be necessary.

Xenon lamp 40 and collimation lens 42 provide white light beam 44 which is projected onto beam splitter 46. Beam splitter 46 directs beam 48, a portion of beam 44, towards the face of electrochromic light valve 32. Beam 48 is filtered by electrochromic dye 20 and reflected off mirror 18 as beam 50. Splitter 46 passes a portion of beam 50 to projection lens 52 which projects beam 50 onto screen 54.

The high impedance of the off state of photoconductor 14 increases the resistor-capacitor circuit discharge time, electrochromic dye 20 retains its charge until scanning laser beam 34 returns and recharges the pixel. Therefore, the entire photochromic image is present at all times. However, for clarity, FIG. 4 shows only a single, representative light beam 48 entering a single pixel in electrochromic light valve 32 and exiting as a beam 50. It should be understood that all pixels are simultaneously illuminated and projected.

Although the invention has been shown and described with respect to a best mode embodiment thereof, it should be understood that changes, omissions and deletions in the form and detail thereof may be made without departing from the spirit and scope of this invention.

What we claim is:

1. An apparatus for displaying a multi-color pattern comprising:

a voltage source;

a plurality of portions of electrochromic material, each portion comprising an associated electrochromic pixel;

insulating means for separating each pixel from adjacent pixels;

control means comprising a layer of photoconductive material disposed adjacent to said layer of electrochromic material, said layer of photoconductive material being comprised of a plurality of portions of photoconductive material respectively in series with said plurality of pixels, for selectively applying a voltage from said voltage source to said pixels; and addressing means for selectively addressing said pixels, said addressing means being a laser for selectively controllably illuminating said plurality of portions of photoconductive material with light from said laser single portions of electrochromic material forming said pixels.

2. An apparatus in accordance with claim 1 wherein the wavelength of light absorbed by each said electrochromic pixel is controlled by the magnitude of the voltage developed across said electrochromic pixel, said apparatus further including:

a conducting mirror disposed between said electrochromic material and said photoconductor material;

said electrochromic material, said conducting mirror, said photoconductor and said voltage source being electrically in series;

interface means for receiving data representing said multicolor pattern for correlating the selective addressing of each said electrochromic pixel by said addressing means and for controlling the magnitude of the voltage developed across each said electrochromic pixel as a function of the received data;

wherein said addressing means, said control means, and said plurality of pixels cooperate to provide said multicolor pattern;

illuminating means for providing light to said plurality of electrochromic pixels; and projection means for projecting light reflected from said plurality of electrochromic pixels.

3. An apparatus in accordance with claim 2 wherein said control means further includes a first transparent electrode disposes on a first side of said electrochromic pixels; and a second transparent electrode disposed on a second side of said plurality of electrochromic.

4. An apparatus in accordance with claim 3 further comprising an electrolyte located between said second transparent electrode and said electrochromic material.

5. An apparatus of claim 2 wherein said illuminating means comprises a light source, a beam splitter located between said light source and said plurality of electrochromic pixels, wherein said beam splitter is also located between said plurality of electrochromic pixels and said projection means directing a portion of the light towards the plurality of pixels and passing light from said conducting mirror to said projection means.

* * * * *